US012674268B2

(12) United States Patent
Becchio et al.

(10) Patent No.: US 12,674,268 B2
(45) Date of Patent: Jul. 7, 2026

(54) MICROPLASTIC FILTERING SYSTEM INTEGRATED WITH A PREFILTERING ASSEMBLY, FOR A WASHING MACHINE, SUCH AS A LAUNDRY WASHING MACHINE

(71) Applicant: ELBI INTERNATIONAL S.P.A, Turin (IT)

(72) Inventors: Marco Becchio, Carignano (IT); Gianluca Benedetto, Turin (IT); Massimo Davi, Bussoleno (IT); Luca Garetto, Turin (IT); Luca Maiorana, Turin (IT)

(73) Assignee: ELBI INTERNATIONAL S.P.A, Turin (IT)

( * ) Notice: Subject to any disclaimer, the term of this patent is extended or adjusted under 35 U.S.C. 154(b) by 135 days.

(21) Appl. No.: 18/824,502

(22) Filed: Sep. 4, 2024

(65) Prior Publication Data

US 2025/0075405 A1 Mar. 6, 2025

(30) Foreign Application Priority Data

Sep. 4, 2023 (IT) ..... 102023000018120

(51) Int. Cl.
*D06F 39/10* (2006.01)
*D06F 39/08* (2006.01)
*D06F 39/12* (2006.01)

(52) U.S. Cl.
CPC ..... *D06F 39/10* (2013.01); *D06F 39/085* (2013.01); *D06F 39/12* (2013.01)

(58) Field of Classification Search
CPC ..... D06F 39/10
See application file for complete search history.

(56) References Cited

U.S. PATENT DOCUMENTS

2019/0176165 A1* 6/2019 Welch ..... B03C 1/0335
2020/0370226 A1* 11/2020 Scheible ..... D06F 58/24
(Continued)

FOREIGN PATENT DOCUMENTS

CN 107447452 A 12/2017
CN 113731007 A 12/2021
(Continued)

OTHER PUBLICATIONS

Search Report for Italian Patent Application No. 102023000018120 (Jan. 16, 2024).

*Primary Examiner* — Spencer E. Bell
(74) *Attorney, Agent, or Firm* — Merchant & Gould P.C.

(57) ABSTRACT

A system includes a casing internally defining a filtering cavity and having an inlet leading into the filtering cavity and configured to be hydraulically connected downstream of a discharge pump and to receive a fluid containing microplastics. The casing also has an outlet configured to deliver the fluid contained in the filtering cavity, from which the microplastics have been substantially removed. A filtering assembly contained in the filtering cavity is crossed by the fluid entering the casing through the inlet and exiting through the outlet, thus internally trapping the microplastics. A compacting assembly is situated in the filtering cavity and configured for collecting and compacting the solid particles trapped by the filtering assembly. A pre-filtering assembly is configured to be fluidically connected upstream of a discharge pump to trap any foreign bodies that may be present in the microplastic-containing fluid.

10 Claims, 6 Drawing Sheets

(56) References Cited

U.S. PATENT DOCUMENTS

| | | | | |
|---|---|---|---|---|
| 2022/0154385 | A1* | 5/2022 | Antell | D06F 39/085 |
| 2023/0030772 | A1 | 2/2023 | Root et al. | |
| 2023/0078618 | A1 | 3/2023 | Becchio et al. | |
| 2024/0150953 | A1* | 5/2024 | Milz | D06F 39/088 |

FOREIGN PATENT DOCUMENTS

| | | | |
|---|---|---|---|
| CN | 114808397 | A | 7/2022 |
| EP | 4148178 | A1 | 3/2023 |

* cited by examiner

MICROPLASTIC FILTERING SYSTEM INTEGRATED WITH A PREFILTERING ASSEMBLY, FOR A WASHING MACHINE, SUCH AS A LAUNDRY WASHING MACHINE

This application claims benefit of Italian Patent Application No. 102023000018120, filed Sep. 4, 2023, which application is incorporated herein by reference. To the extent appropriate, a claim of priority is made to the above-disclosed application.

TECHNICAL FIELD

The present invention relates to a microplastic filtering system for a washing machine, such as a laundry washing machine.

TECHNICAL BACKGROUND

Microplastic filtering systems for washing machines, such as laundry washing machines, are known in the art.

In recent years, the use of synthetic fabrics has increased, resulting g in larger amounts of micrometric synthetic microfibres contained in wastewater and hence in the environment, leading to more environmental pollution. In particular, when synthetic fabrics are washed, synthetic microfibres are produced/released which are not biodegradable, thus causing increased water pollution from microplastics (this term refers to particles and/or fibres less than 5 mm in length).

Patent publication EP 4 148 178 A1 by the present Applicant describes a microplastic filtering system specifically intended for use in a laundry washing machine. The system can filter microplastics contained in the washing liquid, which is then drained from the washing tub. Although such system is particularly advantageous and effective in comparison with those previously known in the art, it is nonetheless desirable to add thereto some improvements and refinements.

One drawback of the system disclosed by patent publication EP 4 148 178 A1 lies in the fact that, for such a system to be integrated into a laundry washing machine, it is necessary to add a further component, thus increasing the number of separate elements to be installed in the machine. This results in increased structural complexity of a laundry washing machine comprising such a system.

SUMMARY OF THE INVENTION

It is one object of the present invention to provide a microplastic filtering system for a washing machine, such as a laundry washing machine, wherein such system can remedy one or more drawbacks of the prior art.

In particular, compared with the prior art, the system made in accordance with the present invention solves the technical problem of not increasing the structural complexity of the laundry washing machine in which the system is intended to be installed. In this regard, an advantageous feature is the inclusion in the system of a pre-filtering assembly for a discharge pump of the washing machine in which said system is to be incorporated. In this way, notwithstanding the addition of such system to the laundry washing machine, the total number of separate components and elements is not increased, since the pre-filtering element is integrated into the system. Therefore, the system according to the present invention provides both filtering of any foreign bodies upstream of the discharge pump and filtering of microplastics.

According to the present invention, this and other objects are achieved through a system having the technical features set out in the appended independent claim.

It is understood that the appended claims are an integral part of the technical teachings provided in the following detailed description of the present invention. In particular, the appended dependent claims define some preferred embodiments of the present invention that include some optional technical features.

Further features and advantages of the present invention will become apparent in light of the following detailed description, provided herein merely as a non-limiting example and referring, in particular, to the annexed drawings as summarized below.

Figure 1:
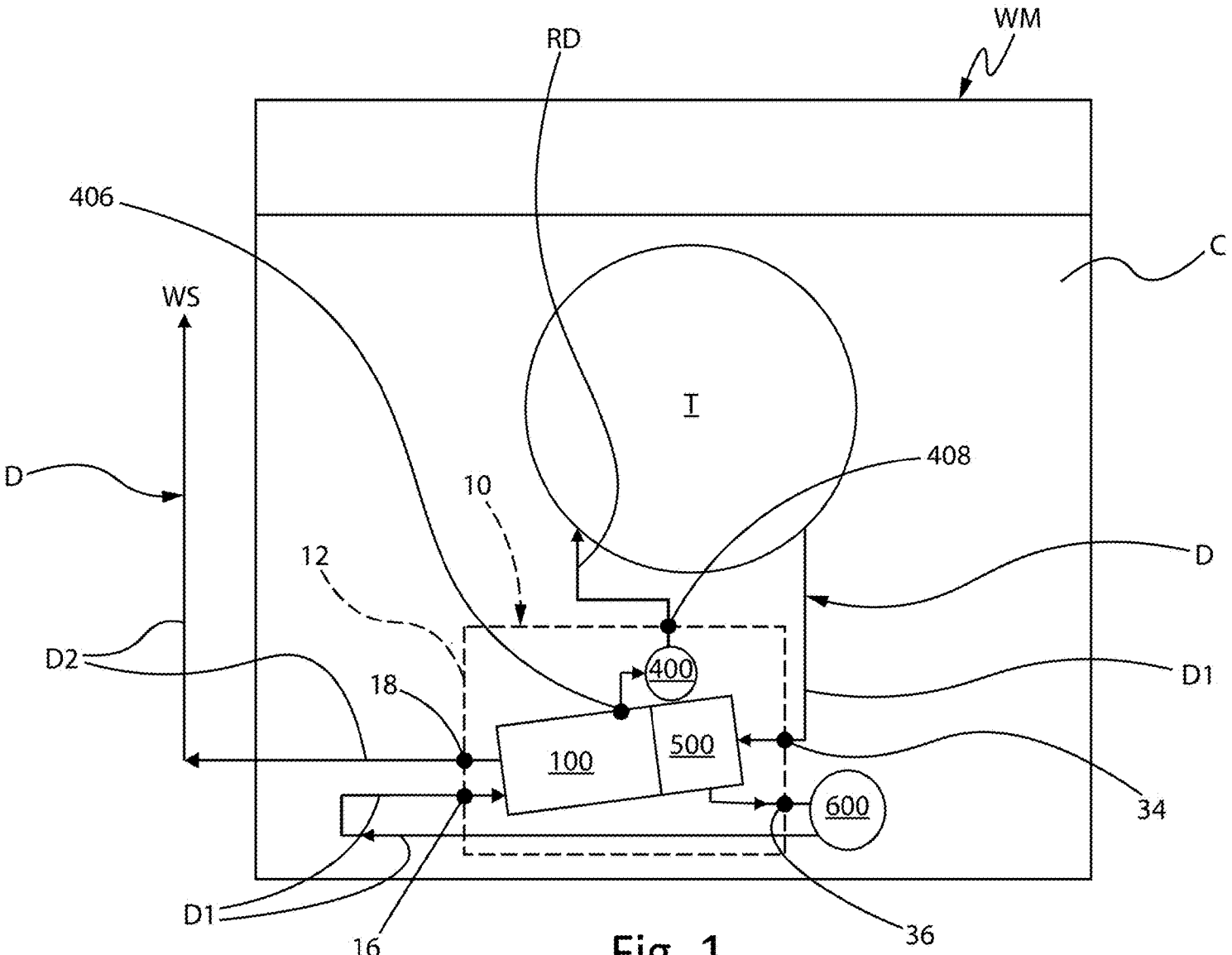
FIG. 1 is a schematic view representing a washing machine, such as a laundry washing machine, in which a filtering system made in accordance with an illustrative embodiment of the present invention has been installed.

For completeness' sake, the following is a list of alphanumerical references and names used herein to identify parts, elements and components illustrated in the above-summarized drawings.

WM. Laundry washing machine
c. Cabinet
T. Washing Tub
D. Discharge piping
D1. Initial duct
D2. Terminal duct
WS. Waste system
RD. Return duct
X-X. Longitudinal axis
10. Filtering system
12. Casing
14. Filtering cavity
14*a*. Central chamber
14*b*. Peripheral chamber
14*c*. Storing chamber
16. Inlet
18. Outlet
20. Storing container
21. Clamping ring
22. Tubular portion
24. Cover member
26. Closure member
28. Draining duct
29. Spacer
30. Sealing gaskets
32. Pre-filtering cavity
32*a*. Inflow chamber
32*b*. Outflow chamber

34. Inlet passageway
36. Outlet passageway
38. Central upright
40. Grip disc
41. Bottom wall
42. Braces
100. Filtering assembly
102. Hollow filtering body
104. Axial through aperture
106. Support shell
108. Lateral slots
200. Compacting assembly
202. Endless screw
204. Helicoidal profile
300. Driving assembly
302. Electric motor
303. Reduction gear train
304. Shaft
400. Draining pump
402. Rotor
404. Tube
406. Inlet opening
408. Outlet opening
410. Elbow connection
500. Pre-filtering assembly
502. Transverse septum
504. Narrow openings
600. Discharge pump
602. Pump inlet
604. Pump outlet

DETAILED DESCRIPTION OF THE INVENTION

With reference to FIGS. 1 to 4, numeral 10 designates as a whole a microplastic filtering system made in accordance with an illustrative embodiment of the present invention. System 10 is applicable to a washing machine, such as a laundry washing machine. The term "microplastics" refers to particles and/or fibres of synthetic or plastic material which are less than 5 mm in length, and which, in particular, may also have micrometric dimensions.

In the embodiment illustrated herein, system 10 will be described with particular reference to a laundry washing machine WM.

With particular reference to FIG. 1, laundry washing machine WM comprises a cabinet C in which a washing tub T is defined, which is sealed from the outside environment by a door (not shown). Laundry washing machine WM comprises also, in a per se known manner, a basket (not shown) rotatably mounted in washing tub T.

Figure 3:
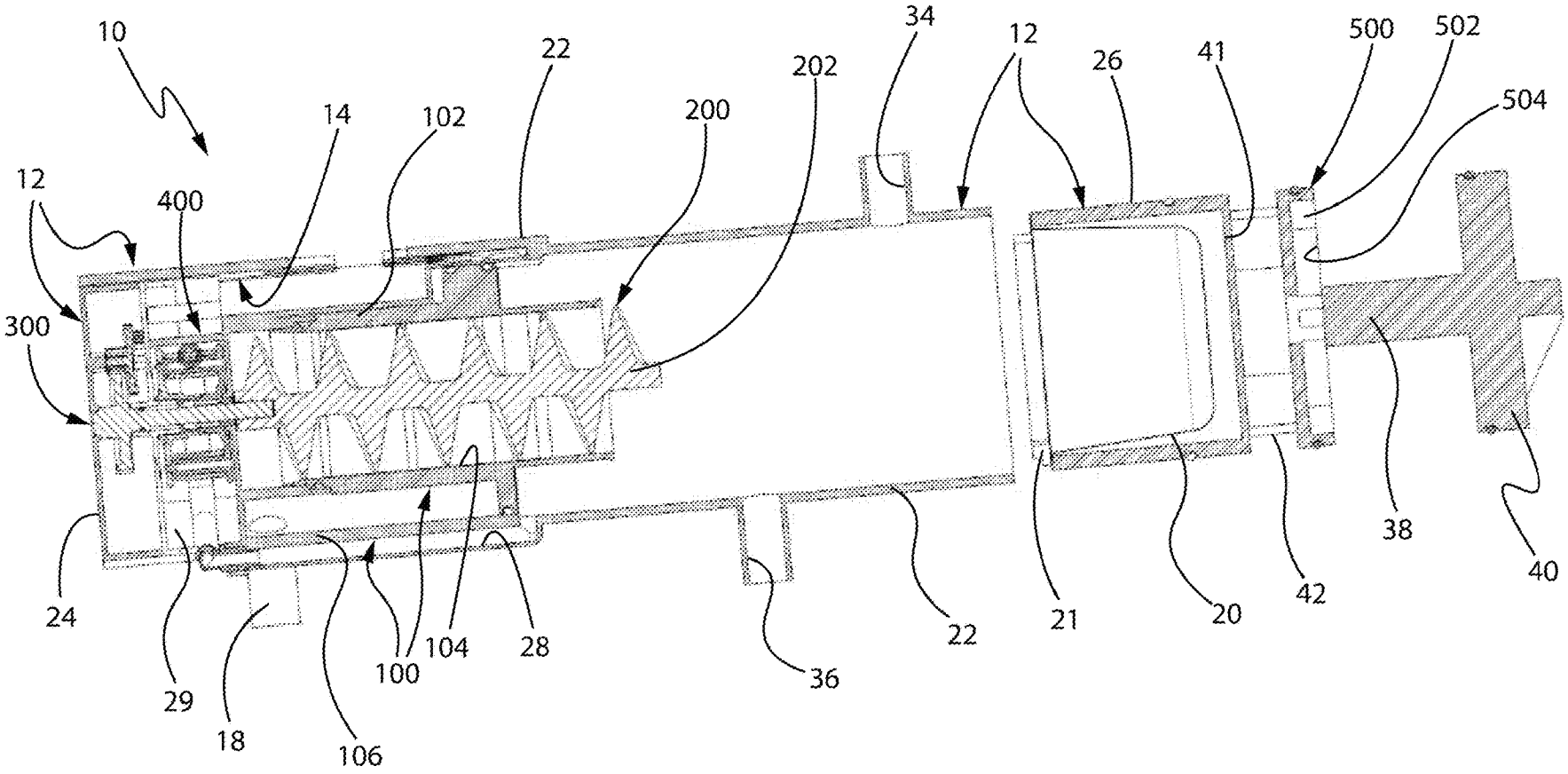
FIG. 3 is a view similar to FIG. 2, wherein a part of the casing is shown in an extracted condition.
Figure 4:
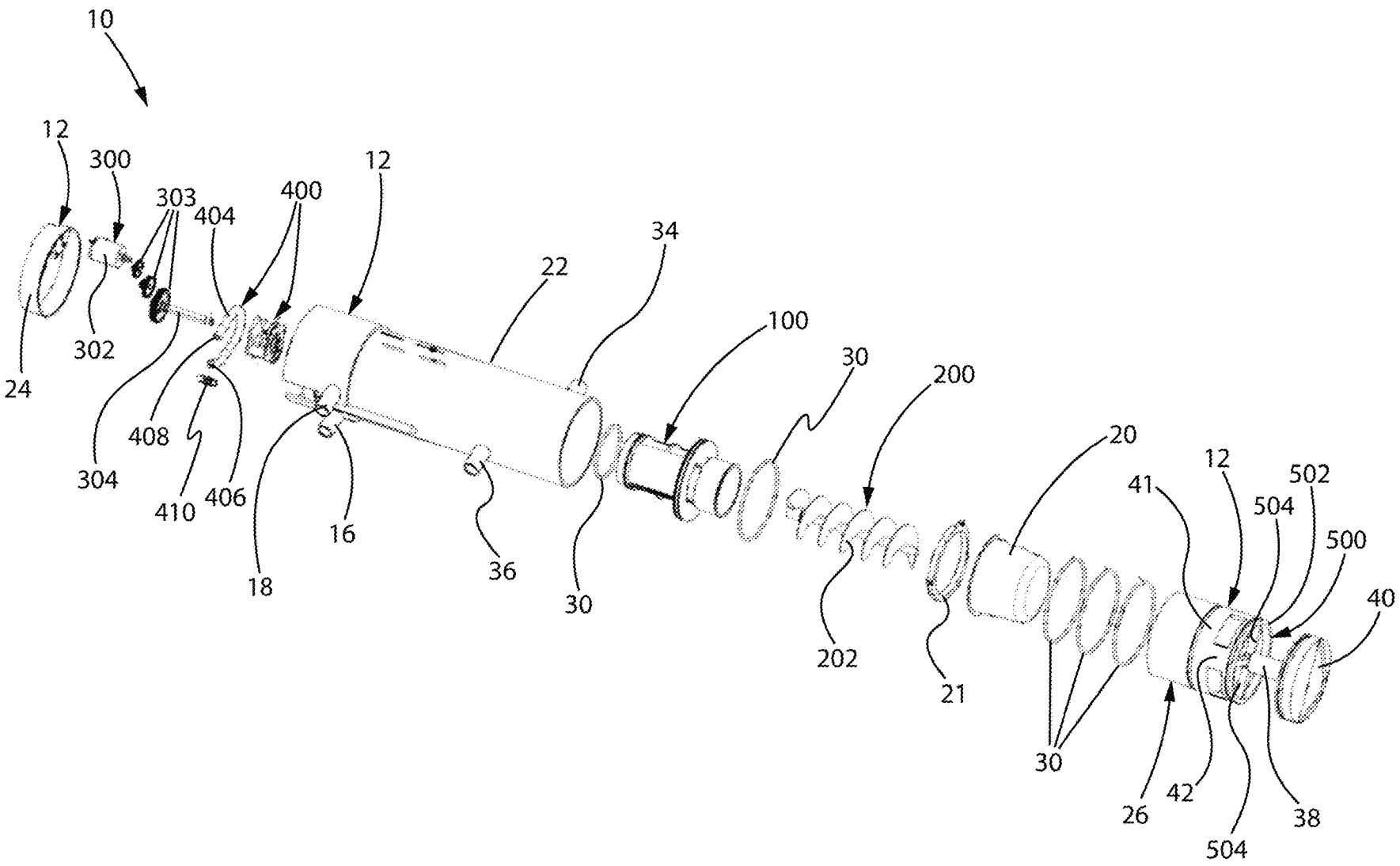
FIG. 4 is an exploded perspective view of the system shown in the preceding Figures.

As will be further described below also with reference to FIGS. 2 to 4, system 10 comprises a casing 12 internally defining a filtering cavity 14 (details thereof are visible in FIGS. 2 and 3). Casing 12 has a substantially tubular shape and develops along a longitudinal axis X-X.

In the embodiment described herein, terms or expressions such as "axial" or "axially", "transversal" or "transversally", "radial" or "radially", "lateral" or "laterally", "internal" or "internally", "external" or "externally", "annular" or "annularly", "peripheral" or "peripherally" are meant to refer to longitudinal axis X-X.

In addition, casing 12 comprises an inlet 16 configured to receive a fluid that contains microplastics and leading into the filtering cavity 14. Casing 10 comprises also an outlet 18 configured to deliver the fluid contained in filtering cavity 14, from which the microplastics have been substantially removed.

System 10 further comprises a filtering assembly 100 contained in filtering cavity 14. Filtering assembly 100 is configured to be crossed by the fluid entering casing 12 through inlet 16 and exiting through outlet 18, thus internally trapping the microplastics contained in said fluid. In particular, filtering assembly 100 is, in a per se known manner, configured for trapping particles and/or fibres of synthetic or plastic material less than 5 mm in length, which may also, in particular, have micrometric dimensions.

In the embodiment shown in FIG. 1, system 10 is fluidically mounted to a discharge piping, designated as a whole as D, of laundry washing machine WM. Discharge piping D is fluidically connected to washing tub T on one side and connectable to waste system WS on the other side. In particular, discharge piping D comprises an initial duct D1 fluidically connected to washing tub T on one side and to inlet 16 of system 10 on the other side; discharge piping D comprises also a terminal duct D2, in turn fluidically connected to outlet 18 of system 10 on one side and fluidically connectable to waste system WS on the other side. Therefore, a "dirty" washing liquid, which contains microplastics, coming from washing tub T flows in initial duct D1, while the "filtered" washing liquid, substantially free from such microplastics, flows in terminal duct D2.

Furthermore, in the embodiment illustrated herein, washing machine WM comprises a discharge pump 600 crossed by initial duct D1 and fluidically connected downstream of washing tub T and upstream of inlet 16 of system 10. Discharge pump 600 is configured to push the washing liquid, containing microplastics and coming from washing tub T, towards inlet 16 of system 10.

System 10 comprises also a pre-filtering system 500 configured to be fluidically connected upstream of discharge pump 600 for trapping any foreign bodies that may be present in the microplastic-containing washing liquid. Thanks to such technical features, the structural complexity of the washing machine in which system 10 is installed is not increased.

In a per se known manner, pre-filtering assembly 500 is configured to be crossed by the microplastic-containing washing liquid—which will then be filtered by filtering assembly 110—and trap any foreign bodies that may be present in such washing liquid. Typically, foreign bodies are much bigger than microplastic particles, and may damage discharge pump 600.

In particular, pre-filtering assembly 500 is crossed by initial duct D1 and is fluidically connected downstream of washing tub T. Pre-filtering assembly 500 is configured for filtering any foreign bodies that may be present in the microplastic-containing washing liquid coming from washing tub T before the washing liquid enters discharge pump 600. Typically, the outlet of pre-filtering assembly 500 is hydraulically connected to the inlet of discharge pump 600. Therefore, pre-filtering assembly 500 and discharge pump 600 are fluidically connected in series in initial duct D1.

In the embodiment illustrated herein, pre-filtering assembly 500 is supported by casing 12. In more detail, casing 12 internally defines a pre-filtering cavity 32 which is fluidically separate from filtering cavity 14. Pre-filtering cavity 32 houses pre-filtering assembly 500.

In particular, casing 12 has an inlet passageway 34 configured to receive the washing liquid containing microplastics and any foreign bodies, and leading into pre-filtering cavity 32 upstream of pre-filtering assembly 500.

In addition, casing 12 has an outlet passageway 36 configured to deliver the microplastic-containing washing liquid, which is intended to cross pre-filtering cavity 32, and from which any foreign bodies have been substantially removed.

Inlet passageway 34 is also configured to be hydraulically connected downstream of washing tub T of laundry washing machine WM.

Outlet passageway 36 is also configured to be hydraulically connected upstream of inlet 16 and of discharge pump 600.

System 10 comprises, therefore, two filters, comprising filtering assembly 100 and pre-filtering assembly 500, which are fluidically decoupled from each other, and between which discharge pump 600 is fluidically interposed.

Pre-filtering assembly 500 comprises a transverse septum 502 situated in pre-filtering cavity 32 and having a plurality of narrow openings 504 configured to be crossed by the micro-plastic-containing washing liquid and to trap any foreign bodies that may be present in the washing liquid.

In the embodiment illustrated herein, casing 12 comprises a tubular portion 22, a cover member 24 and a closure member 26 sealingly connected to tubular portion 22 on opposite sides, thereby internally defining filtering cavity 14. In particular, filtering cavity 14 is laterally delimited by tubular portion 22 and axially delimited, on opposite sides, by cover member 24 and closure member 26. Tubular portion 22 develops around longitudinal axis X-X.

In particular, pre-filtering cavity 32 is laterally delimited by tubular portion 22, while being—as will be described in more detail hereafter—axially delimited on opposite sides by walls of closure member 26.

As will be described in more detail below, inlet 16 and outlet 18 lead into filtering cavity 14 through casing 12 in a substantially transversal direction (i.e. substantially perpendicular to longitudinal axis X-X). In the embodiment illustrated herein, inlet 16 and outlet 18 are formed laterally on casing 12, i.e. with axes oriented transversally to longitudinal axis X-X. In more detail, inlet 16 and outlet 18 are formed on tubular portion 22. In the embodiment illustrated herein, inlet 16 and outlet 18 are provided as fittings laterally protruding from casing 12, in particular from tubular portion 22.

In the embodiment illustrated herein, inlet passageway 34 and outlet passageway 36 lead into pre-filtering cavity 32 through casing 12 in a substantially transversal direction (i.e. substantially perpendicular to longitudinal axis X-X). In the illustrated embodiment, inlet passageway 34 and outlet passageway 36 are formed laterally on casing 12, i.e. with axes oriented transversally to longitudinal axis X-X. In more detail, inlet passageway 34 and outlet passageway 36 are formed on tubular portion 22. In the illustrated embodiment, inlet passageway 34 and outlet passageway 36 are provided as fittings laterally protruding from casing 12, in particular from tubular portion 22, axially offset relative to longitudinal axis X-X and radially offset by 180° relative to longitudinal axis X-X.

In the embodiment illustrated herein, pre-filtering assembly 500 is supported by closure member 26. In particular, closure member 26 comprises a central upright 38 extending from transverse septum 502 and coaxial to longitudinal axis X-X. Openings 504 extend in a sunburst pattern on transverse septum 502 around central upright 38.

In particular, closure member 26 comprises a grip disc 40 mounted to central upright 38 on the side axially opposite transverse septum 502. In particular, grip disc 40 and transverse septum 502 are sealingly mounted within tubular portion 22.

System 10 comprises also a compacting assembly 200 situated in filtering cavity 14 and configured for collecting and compacting the microparticles trapped by filtering assembly 100.

In addition, system 10 comprises a driving assembly 300 configured to drive compacting assembly 200. Preferably, driving assembly 300 comprises a motor, in particular an electric motor 302. In the illustrated embodiment, electric motor 302 co-operates with a reduction gear train 303 to drive compacting assembly 200. In particular, driving assembly 300 is housed in cover member 24.

Preferably, filtering assembly 100 comprises a hollow filtering body 102 having an axial through aperture 104. Hollow filtering body 102 comprises, advantageously, a plurality of concentrical cylindrical filtering layers of different mesh gauges suitable for trapping microplastic particles of different sizes. In the embodiment illustrated herein, filtering assembly 100 comprises a support shell 106, in which hollow filtering body 102 is mounted. In addition, support shell 106 has a plurality of lateral apertures or slots 108 (only one of which is numbered in FIG. 2) forming a "cage" that laterally supports hollow filtering body 102 and allows fluid to flow therethrough. In the embodiment illustrated herein, filtering assembly 100 is removable from casing 12.

Preferably, as will be described hereafter, compacting assembly 200 extends axially through filtering assembly 100. In particular, axial through aperture 104 of hollow filtering body 102 is crossed by compacting assembly 200.

In the embodiment illustrated herein, compacting assembly 200 is configured to remove microplastics from the inner surface of hollow filtering body 102, in particular conveying them out of filtering assembly 100. In other words, compacting assembly 200 is operatively mounted in contact with the inner lateral surface of hollow filtering body 102, defined by axial through aperture 104, for removing microplastics from the filtering assembly. In this manner, compacting assembly 200 is configured to operatively slide against said inner lateral surface of hollow filtering body 102, thereby removing microplastics from such surface.

In the illustrated embodiment, compacting assembly 200 comprises an endless screw 202 configured to be rotatably driven by driving assembly 300, so as to axially push the solid particles trapped by filtering assembly 100.

In addition, endless screw 202 is housed in axial through aperture 104 of hollow body 102, and is substantially aligned axially with longitudinal axis X-X.

In particular, endless screw 202 has a helicoidal profile 204 that, in a per se known manner, facilitates the conveyance of microplastics out of filtering assembly 100. In other words, helicoidal profile 204 is operatively mounted in contact with the inner lateral surface of hollow filtering body 102. In this way, helicoidal profile 204—rotatably driven by driving assembly 300—can effectively remove the microplastics deposited on said surface of hollow filtering body 102. In fact, helicoidal profile 204 is configured to rotatably slide against said surface of hollow filtering body 100, thereby removing microplastics therefrom.

Figure 2:
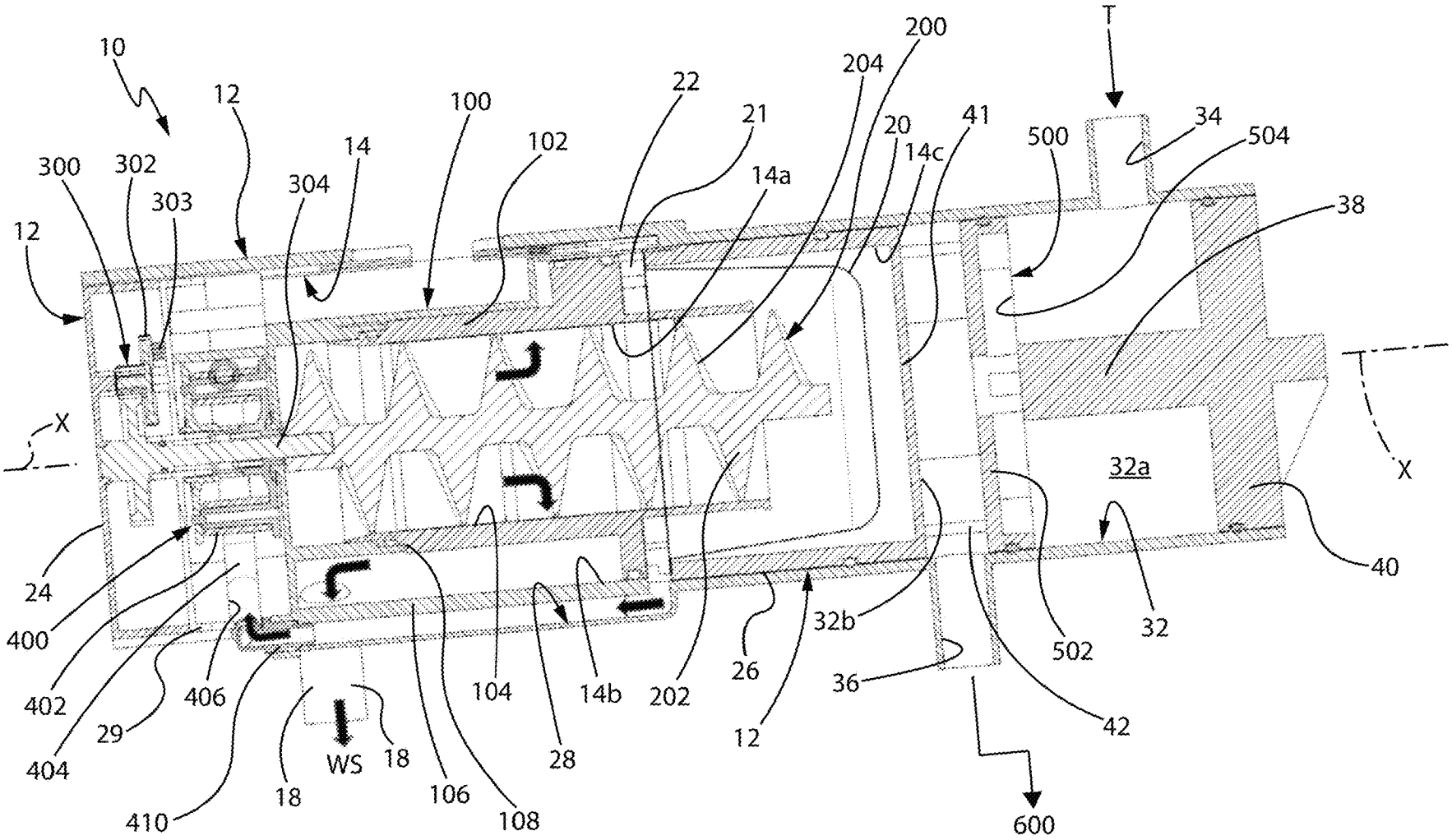
FIG. 2 is a two-dimensional axial sectional view of the system shown in FIG. 1.

As clearly visible in FIG. 2, filtering cavity 14 is divided into a plurality of chambers 14*a*, 14*b*, 14*c*, in particular by inner walls of casing 12 and/or outer walls of filtering assembly 100, in particular of support shell 106. There is a central chamber 14*a*, laterally and axially delimited within filtering assembly 100, into which inlet 16 directly leads;

central chamber 14*a* is axially crossed by compacting assembly 200 (in particular, by endless screw 202). In particular, central chamber 14*a* is also delimited laterally within hollow filtering body 102 and axially by an axial end of support shell 106. There is also a peripheral chamber 14*b* situated around central chamber 14*a* and bordering thereon via the walls of hollow filtering body 102, while it is delimited axially by an axial end of support shell 106; outlet 18 extends from peripheral chamber. Lastly, there is a storing chamber 14*c* facing towards compacting assembly 12 (in particular, facing towards a free end of endless screw 202). In addition, storing chamber 14*c* is adjacent, in the axial direction, to central chamber 14*a* and in direct fluidic communication with such central chamber 14*a*; said storing chamber 14*c* is laterally and axially delimited by casing 12, in particular by closure member 26.

System 10 further comprises a storing container 20 situated in storing chamber 14*c* and facing towards compacting assembly 200. Storing container 20 is configured to receive the microplastics collected and compacted by compacting assembly 200. Particularly, storing container 20 is removable from filtering cavity 14 and accessible through casing 12.

In the embodiment illustrated herein, storing container 20 is housed in closure member 26, which internally defines storing chamber 14*c*. In particular, storing container 20 is substantially cup-shaped, and closure member 26 is substantially glass-shaped. In particular, storing container 20 and closure member 26 are mutually assembled by means of a clamping ring 21, wherein a peripheral edge of storing container 20 is axially locked between clamping ring 21 and a corresponding peripheral edge of closure member 26. In addition, axial through aperture 104 of hollow body 102 faces towards storing container 20. Closure member 26 is mounted to tubular portion 22 and removable, in particular repeatably and reversibly, therefrom. For example, as shown in FIG. 3, closure member 26 can be coupled to and, respectively, removed from tubular portion 22 (or, more generally, the rest of casing 12), so that a user can gain access to the inside of casing 12. Particularly, a bayonet mechanism or a threaded connection may be provided for removably coupling closure member 26 to tubular portion 22 (or, more generally, to the rest of casing 12). Therefore, by removing closure member 26 from tubular portion 22 it is possible to remove and/or replace storing container 20 from casing 12 in order to empty it of the microplastics accumulated therein and compacted by compacting assembly 200.

In the embodiment illustrated herein, pre-filtering assembly 500, in particular its transverse septum 502, is mounted to closure member 26 on the side axially opposite storing container 20, in particular on the bottom wall 41 that delimits storing chamber 14*c*. Preferably, closure member 26 comprises a plurality of braces 42 axially connecting the periphery of bottom wall 41 to the periphery of transverse septum 502.

In particular, in addition to being delimited laterally by tubular portion 22, pre-filtering cavity 32 is also delimited axially by bottom wall 41 and by grip disc 40. In more detail, pre-filtering cavity 32 is divided into an inflow chamber 32*a*, where the washing liquid is intended to enter through inlet passageway 34, and an outflow chamber 32*b*, from where the washing liquid is intended to exit through outlet passageway 36 after any foreign bodies have been substantially removed therefrom. Inflow chamber 32*a* and outflow chamber 32*b* communicate with each other through pre-filtering assembly 500, in particular through the narrow openings 504. Inflow chamber 32*a* is axially delimited by grip disc 40 and by transverse septum 502, while outflow chamber 52*b* is axially delimited by transverse septum 502 and by bottom wall 41.

Preferably, closure member 26 provides a support structure which supports both storing container 20 and pre-filtering assembly 500, forming a unitary module mounted repeatably and reversibly removable (e.g. extractable) from tubular portion 22.

System 10 further comprises a draining pump 400 configured for taking in liquid contained in storing chamber 14*c* and pushing such liquid out of casing 12. Thus, liquid is prevented from stagnating in the storing container and interfering with the normal operation of compacting assembly 200, with the risk of clogging filtering assembly 100—particularly when system 10 is installed in laundry washing machine WM with longitudinal axis X-X oriented in a substantially horizontal direction (e.g. according to the arrangement shown in FIG. 2). This increases the general filtering effectiveness of system 10.

In the system arrangement shown in FIG. 1, longitudinal axis X-X is oriented in a substantially horizontal direction, with such an inclination that storing chamber 12*c* and storing container 20 are in a higher position than filtering assembly 100 and compacting assembly 200. This facilitates the outflow of the washing liquid from central chamber 14*a* towards peripheral chamber 14*b*.

Preferably, draining pump 400 is of the peristaltic type. In particular, draining pump 400 comprises, in a per se known manner, a rotor 402 and an elastically deformable tube 404, having an inlet opening 406 and an outlet opening 408 (only visible in FIG. 3). Rotor 402 is configured to co-operate with the respective tube 404 to push the stagnating liquid contained in the corresponding storing chamber 14*c*. Also, rotor 402 comprises a pair of projecting portions (not numbered), on preferably situated diametrically opposite sides, adapted to be placed in contact with the deformable walls of tube 404. In particular, such projecting portions are adapted to locally throttle tube 404 and cause the liquid contained in the latter to flow on during the rotation of rotor 402. Preferably, each one of the projecting portions comprises a peripheral roller adapted to locally press on tube 404 in order to throttle it.

In the embodiment illustrated herein, tube 404 is mounted in such a way that its outlet opening 408 leads out of system 10, particularly out of casing 12, so as to discharge in washing tub T any washing liquid L stagnating in storing chamber 14*c*. In particular, as shown in FIG. 1, laundry washing machine WM comprises a return duct RD hydraulically connected to outlet opening 408 on one side and to an inlet of washing tub T on the other side.

Preferably, casing 12 defines a draining duct 28 fluidically connected to storing chamber 14*c* on one side and to the inlet of draining pump 400 on the other side—in particular, to inlet opening 406. In the embodiment illustrated herein, the hydraulic connection of draining duct 28 is provided by means of an elbow connection 410 hydraulically connected to inlet opening 406 on one side and to one end of draining duct 28 on the other side.

Preferably, draining duct 28 is defined on the periphery of casing 12 (e.g. of the latter's tubular portion 22).

In the embodiment illustrated herein, draining duct 28 extends along casing 12 (in particular, along tubular portion 22) in a substantially axial direction.

In the embodiment illustrated herein, draining duct 28 is defined by an interspace laterally delimited between casing 12 (in particular, the latter's tubular portion 22) and filtering assembly 100 (in particular, the latter's support shell 106).

Preferably, draining pump 400 is supported between casing 12 (in particular, cover member 24) and filtering assembly 100 (in particular, an axial end of support shell 106). In addition, electric motor 302 and reduction gear train 303 are sealingly separated from draining pump 400 through the interposition of a spacer 29.

Driving assembly 300 comprises a shaft 304 configured to be rotatably driven by electric motor 302, in particular via reduction gear train 303, for controlling compacting assembly 200. In particular, shaft 304 extends in filtering cavity 14 in order to co-operate with compacting assembly 200. In the illustrated embodiment, shaft 304 is coupled to endless screw 202 to control the rotation thereof, such two parts being, in particular, rotatably integral (e.g. keyed) with each other. In more detail, shaft 304 and endless screw 202 are substantially coaxial to each other and to longitudinal axis X-X.

Preferably, driving assembly 300 is also configured to control draining pump 400. Thus, when system 10 is in operation, driving assembly 300 provides not only the action of compacting the microplastics towards storing container 20, but also the action of draining any liquid stagnating in storing chamber 14*c*.

In the embodiment illustrated herein, said driving assembly 300 comprises a shaft 304 controllable in rotation and mounted coaxial to both rotor 402 and endless screw 202. In particular, shaft 304 is rotatably supported by casing 12 (in particular, by cover member 24 and/or spacer 29) on one side and, on the axially opposite side, by filtering assembly 100 (in particular, by support shell 106, e.g. by the top thereof). Particularly, shaft 304 axially and sealingly crosses spacer 29 to connect to rotor 402 and endless screw 202.

By way of example, fluid-tightness of casing 12 is obtained by means of a plurality of sealing gaskets 30 interposed between members 24 and 26 and tubular portion 22. In particular, sealing gaskets 30 have a substantially annular shape, e.g. they are O-rings.

For completeness' sake, the following will briefly describe the path followed by the washing liquid in system 10, from washing tub T to waste system WS.

When system 10 is in operation, inlet passageway 34 is hydraulically connected to initial duct D1 of discharge piping D, and is configured to receive, in a substantially transversal or radial direction, the washing liquid coming from washing tub T and containing microplastics and foreign bodies. Inlet passageway 34 then leads into inflow chamber 32*a*, which receives the washing liquid and hydraulically communicates, in the axial direction, with outflow chamber 32*b* through narrow openings 504 of transverse septum 502. Thus, inflow chamber 32*a* traps the foreign bodies upstream of transverse septum 502, so that outflow chamber 32*b* receives washing liquid substantially free from foreign bodies, but still containing microplastics.

Subsequently, from peripheral chamber 14*b* the microplastic-containing washing liquid flows, transversally or radially, through the interspaces defined between braces 42 in outlet passageway 36 and out of tubular portion 22 of casing 12. Outlet passageway 18 is connected to the inlet of discharge pump 600 through initial duct D1 of discharge piping D.

Afterwards, inlet 16, which is hydraulically connected to initial duct D1 of discharge piping D, is configured to receive, substantially in a transversal or radial direction, the microplastic-containing washing liquid delivered by discharge pump 600. Inlet 16 extends transversally or radially through tubular portion 22 of casing 12 and leads into central chamber 14*a* defined by hollow filtering body 102.

Central chamber 14*a* receives the microplastic-containing washing liquid and hydraulically communicates, transversally or radially, with peripheral chamber 14*b* through the sidewalls of hollow filtering body 102. In particular, in the substantially horizontal arrangement of system 10 shown in FIG. 2, the washing liquid flows from central chamber 14*a* to peripheral chamber 14*b* also by gravity, since peripheral chamber 14*b* is underneath. Therefore, central chamber 14*a* retains the microplastics within hollow filtering body 102, so that peripheral chamber 14*b* receives washing liquid which is substantially free from microplastics.

At the same time, central chamber 14*a* hydraulically communicates, in the axial direction, with storing chamber 14*c*, which, due to the action of compacting assembly 200, receives the microplastics retained within the hollow filtering body, and traps them in storing container 20. As previously described, any washing liquid L stagnating in storing chamber 14*c* is drained out of it by draining pump 400.

Subsequently, the washing liquid, from which microplastics have been substantially removed, flows out of peripheral chamber 14*b*, transversally or radially, through outlet 18 to exit tubular portion 22 of casing 12. Outlet 18 is connected to terminal duct D2 of discharge piping D, thus delivering to waste system WS washing liquid which is substantially free from microplastics.

Figure 5:
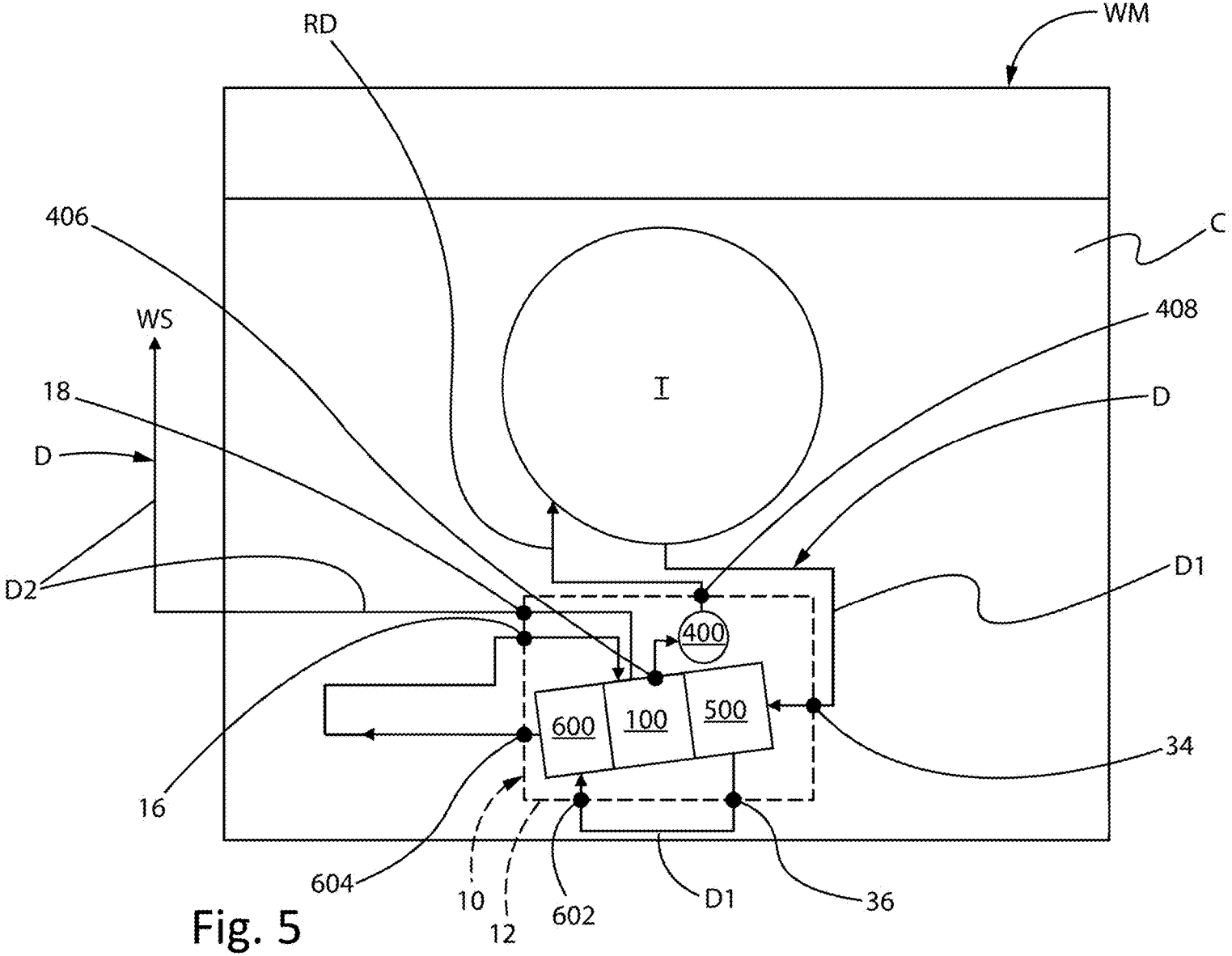
FIG. 5 is a block diagram similar to the one of FIG. 1, showing a filtering system according to a further embodiment of the present invention.
Figure 6:
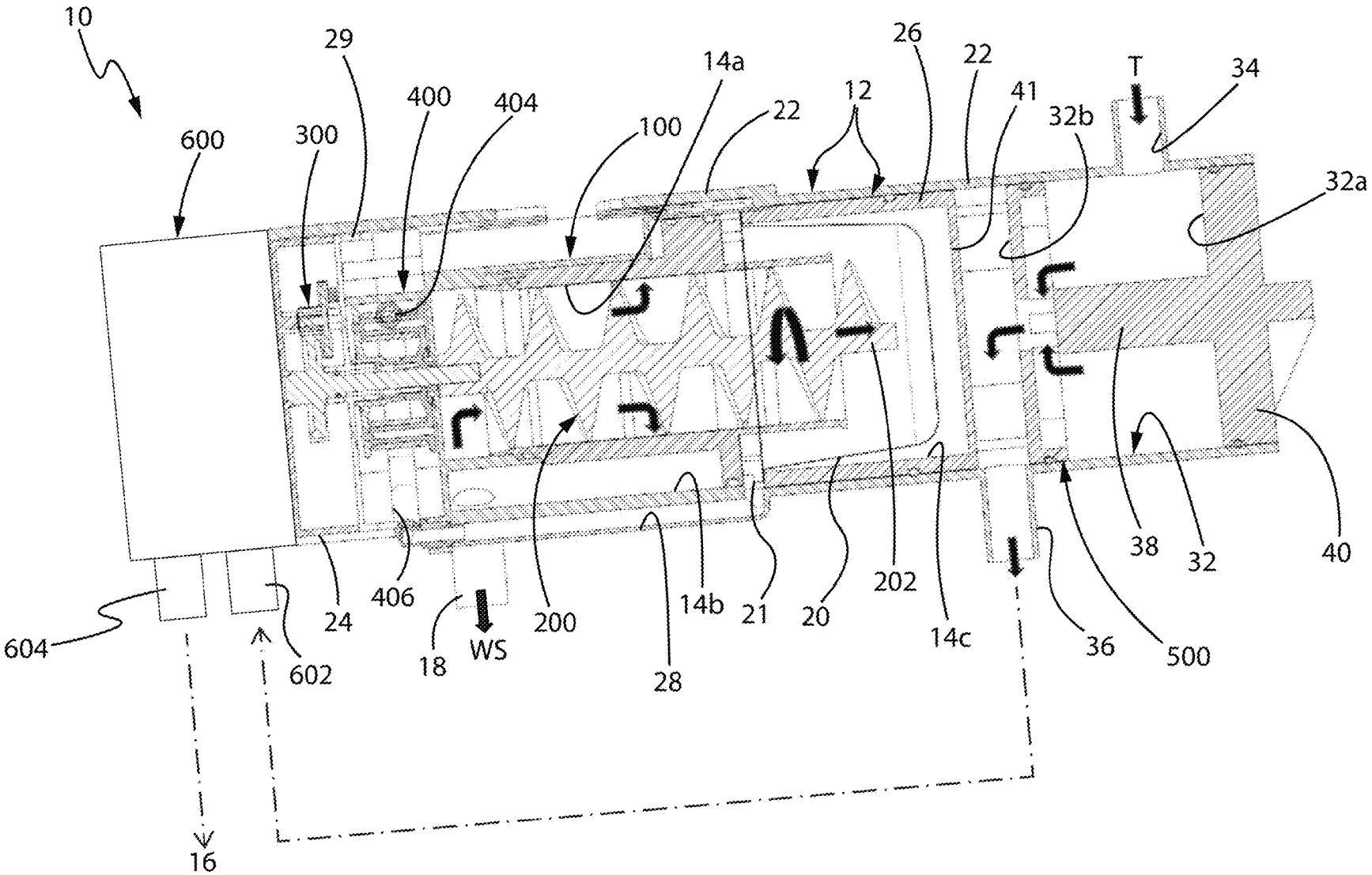
FIG. 6 is a two-dimensional axial sectional view of the system shown in FIG. 5.

With reference to FIGS. 5 and 6, there is shown a system made in accordance with a further embodiment of the present invention.

Those parts and elements which are similar to—or which perform the same function as—those of the previously illustrated embodiment have been assigned the same reference numerals. For brevity, the description of such parts and elements will not be repeated below, and reference should be made to the description of the previous embodiment.

In the illustrated embodiment, system 10 further comprises discharge pump 600.

In particular, discharge pump 600 is supported by casing 12. In more detail, discharge pump 600 is supported by cover member 24, in particular on the side axially opposite driving assembly 300.

Pump inlet 602 of discharge pump 600 is fluidically connected downstream of outlet passageway 36, while pump outlet 604 of discharge pump 600 is fluidically connected upstream of inlet 16.

Of course, without prejudice to the principle of the invention, the forms of embodiment and the implementation details may be extensively varied from those described and illustrated herein by way of non-limiting example, without however departing from the scope of the invention as set out in the appended claims.

The invention claimed is:

1. A microplastic filtering system for a washing machine; said system comprising:

a casing internally defining a filtering cavity and comprising:

an inlet leading into the filtering cavity and configured to be hydraulically connected downstream of a discharge pump of said washing machine and to receive a fluid containing microplastics, and an outlet configured to deliver said fluid crossing said filtering cavity, from which said microplastics have been substantially removed;

a filtering assembly contained in the filtering cavity and configured to be crossed by the fluid entering said casing through the inlet and exiting through said outlet, internally trapping said microplastics;

a compacting assembly in said filtering cavity and configured for collecting and compacting the solid particles trapped by the filtering assembly;

wherein said casing defines a pre-filtering cavity which is fluidically separate from the filtering cavity, and further comprises:

an inlet passageway leading into said pre-filtering cavity and configured to be connected downstream of a washing tub of said washing machine and to receive said fluid containing microplastics and any foreign bodies, and an outlet passageway configured to deliver said microplastic-containing fluid crossing said pre-filtering cavity, from which said foreign bodies have been substantially removed, and configured to be fluidically connected upstream of said discharge pump and said inlet; and a pre-filtering assembly situated in said pre-filtering cavity and configured to be crossed by the fluid entering said casing through said inlet passageway and exiting through said outlet passageway, trapping any of said foreign bodies.

2. The system according to claim 1, wherein said pre-filtering assembly comprises a transverse septum situated in said pre-filtering cavity and having at least one opening configured to be crossed by said microplastic-containing fluid and to trap any of said foreign bodies.

3. The system according to claim 1, further comprising said discharge pump.

4. The system according to claim 3, wherein said discharge pump is supported by said casing.

5. The system according to claim 4, wherein said discharge pump is situated on said casing on a side opposite said pre-filtering assembly.

6. The system according to claim 1, wherein said casing comprises a tubular portion and a closure member removably mounted from said tubular portion in association with said pre-filtering assembly.

7. The system according to claim 6, wherein said pre-filtering cavity is axially delimited by said closure member and laterally delimited by said tubular portion.

8. The system according to claim 6, wherein said tubular portion defines said inlet passageway and said outlet passageway.

9. The system according to claim 6, wherein said closure member further comprises a storing container facing towards said compacting assembly and configured to store the microplastics collected and compacted by said compacting assembly.

10. The system according to claim 9, wherein said closure member supports both said storing container and said pre-filtering assembly, forming a unitary module removably mounted to the tubular portion.

* * * * *